United States Patent [19]

Pennington et al.

[11] Patent Number: 4,678,701

[45] Date of Patent: Jul. 7, 1987

[54] RESISTIVE PRINTING RIBBON HAVING IMPROVED PROPERTIES

[75] Inventors: Keith S. Pennington, Somers; Ali Afzali-Ardakani, White Plains; Krishna G. Sachdev, Wappingers Falls, all of N.Y.

[73] Assignee: International Business Machines Corporation, Armonk, N.Y.

[21] Appl. No.: 793,525

[22] Filed: Oct. 31, 1985

[51] Int. Cl.[4] ..... B41M 5/26

[52] U.S. Cl. ..... 428/213; 219/216; 400/118; 400/119; 400/120; 400/241; 400/241.1; 428/209; 428/212; 428/323; 428/333; 428/409; 428/412; 428/421; 428/422; 428/469; 428/484; 428/688; 428/696; 428/913; 428/914

[58] Field of Search ..... 219/216; 400/118–120, 400/241–241.2; 428/484, 488.1, 913, 914, 195, 201, 209, 212, 213, 323, 332, 409, 412, 421, 422, 469, 488.4, 688, 696

[56] References Cited

U.S. PATENT DOCUMENTS 4,269,892 5/1981 Shattuck et al. ..... 428/337

4,309,117 1/1982 Chang et al. ..... 428/914

4,320,170 3/1982 Findlay ..... 428/913

4,459,055 7/1984 Asakura et al. ..... 428/914

*Primary Examiner*—Bruce H. Hess

*Attorney, Agent, or Firm*—Jackson E. Stanland

[57] ABSTRACT

An improved resistive ribbon for resistive thermal transfer printing is described in which the resistive layer of the ribbon has enhanced thermal and mechanical properties. The ribbon is a multi-layer ribbon including a resistive layer, an electrical current return layer, and an ink layer. The resistive layer has an additive therein which phase separates and concentrates in a thin surface region near the interface of the resistive layer and the current return layer. This thin region has superior thermal and mechanical properties, and protects the remainder of the resistive layer during the printing operation, without adversely affecting the mechanical, electrical, and thermal properties of the overall resistive layer. These additives are those which will form a polymer having a sufficiently high dissociation temperature to withstand the adverse effects of heat build-up at the interface. Suitable additives include graphite fluorides, fluorocarbon resins such as Teflon ®, and $CeF_4$.

15 Claims, 1 Drawing Figure

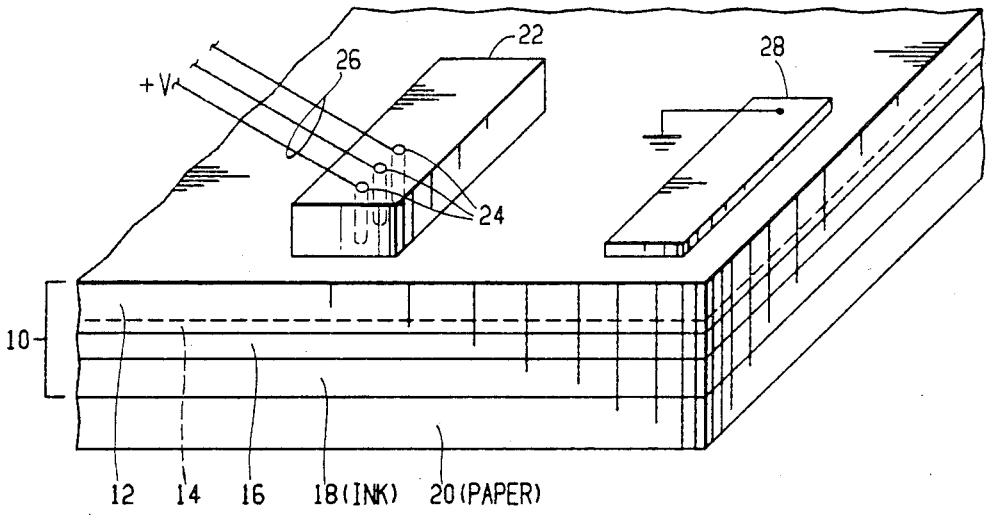
22
28
26
+V
24
10
12
14
16
18 (INK)
20 (PAPER)

RESISTIVE PRINTING RIBBON HAVING IMPROVED PROPERTIES

DESCRIPTION

1. Field of the Invention

This invention relates to a ribbon for resistive ribbon thermal transfer printing having superior thermal and mechanical properties, and more particularly to such a ribbon in which the resistive layer thereof includes a region comprised of a high temperature-resistant polymer which forms near the surface of the resistive layer without the need for additional fabrication steps, the temperature-resistant polymer providing improved thermal properties, passivation, and better print quality.

2. Background Art

Resistive ribbon thermal transfer printing is a relatively new printing technology that provides improved cost/performance and overall functional capabilities to the low speed, high quality office system, word processing, and personal computer output printer environments. In this technology, a matrix printhead produces highly localized joule heating of a conducting thermal transfer ribbon. The heat generated in the resistive ribbon results in the melting of a thermoplastic ink which is then transferred, by contact, to the printed page. This technique is described in, for example, U.S. Pat. No. 3,744,611.

Resistive ribbon thermal transfer printing employs a special electrically resistive printing ribbon, together with a printhead which consists of an array of small diameter electrodes. Injecting current into the ribbon by electrically addressing the printhead electrodes results in high current densities immediately beneath the addressed electrodes, which in turn causes highly localized heating of the ribbon beneath the addressed electrodes. This intense and highly localized heating of the ribbon produces localized melting of a thermoplastic or thermally transferrable ink on the opposite side of the ribbon. The melted ink regions are transferred to a paper or other printable medium which is in contact with the ribbon during the printing cycle. This ability to controllably transfer polymeric inks from highly localized regions of the ribbon results in high quality/high contrast printing. In addition to the high print quality, this type of printing has additional advantages with respect to printing speed and the use of inks that melt at higher temperatures than those that are practical with conventional thermal transfer printers. Additional advantages relate to the use of many different types of printing paper without ink smearing and the reduction of print quality, and the advantage of a relatively simple printhead.

Typically, the resistive ribbon is comprised of several layers, and includes as a minimum a resistive layer and a thermally fusible ink layer. Usually, a thin metal layer (such as Al) is used as a current return path. Still further, a "transfer" layer is often used adjacent to the ink layer in order to facilitate the transfer of ink from the ribbon to the printing medium. An example of a four-layer ribbon comprising an ink layer, a transfer layer, a current return layer, and a resistive layer is found in U.S. Pat. No. 4,320,170.

The resistive layer is typically a carbon-loaded, electrically resistive layer having a thickness of about 16 micrometers and a bulk resistivity of approximately 0.8 ohm-cm. The printing head is usually comprised of an array of small, 25 micrometer diameter, printing electrodes. The electrical current return layer is typically Al, having a thickness of 0.1 micrometer. The electrical current return layer is usually coated with a layer of thermally transferrable polymeric ink of about 4 micrometers thickness. During the printing process the ribbon and head structure is placed in contact with a paper or other printable surface, with the ink side of the ribbon toward the printable surface. When an addressed electrode is pulsed, current passes from the addressed electrode into the ribbon and through the resistive, carbon-loaded polymer into the thin current return layer. The current then flows toward a broad area return, or counterelectrode. As noted, the high current densities that are produced under the contacting print electrodes produce intense heating, causing the thermoplastic ink to melt and be transferred to the receiving sheet.

The resistive layer is typically a carbon-loaded polymer, such as polycarbonate, polyurethanes, polystyrenes, polyketones, polyesters, etc. These polymeric materials are generally chosen to have sufficiently high glass transition temperatures and other mechanical properties which make them suitable for winding upon spools and use as ribbons. The amount of carbon incorporated into the resistive layer is such that the desired resistivity is obtained. Examples of polycarbonate and polyester resistive layers are found in U.S. Pat. Nos. 4,103,066 and 4,269,892, respectively. An example of a composite resistive layer having a low resistivity region and a high resistivity region is described in U.S. Pat. No. 4,309,117.

The electrical current return layer is chosen to have good electrical conductivity and can be comprised of materials such as Al, Au, Ag, stainless steel, graphite, Pt, etc. Of these, the most advantageous appears to be Al. Generally, the thickness of the Al layer is about 1000 angstroms. Thinner Al layers tend to lose continuity when subjected to the shear stress present in the ribbon during printing. Also, if the Al layers are substantially thinner than 1000 angstroms, these layers may present considerable resistance in the return path and a consequent increase in heating. If this heating is too great, plastic flow of the resistive polymer layer can occur and lead to subsequent breakage of the ribbon. Increasing the Al thickness beyond that necessary to provide adequate mechanical strength will result in an increase in the required print energy, as well as tend to reduce print resolution.

It is important when making these ribbons to have good adhesion between the Al layer and the polymer resistive layer. This results in more uniform resistive and thermal characteristics of the ribbon and therefore is important for high quality printing and reliability. While ribbons in general use provide quite good adherence, as the technology advances in printing speed, further improvements in adhesion will be required.

In these ribbons, the primary heating occurs at the Al/resistive layer interface. This localized heating can cause reliability problems, especially if the heat is such that the resistive layer dissociates. This effect can occur since the resistive layer is generally exposed to the high localized temperatures produced during the printing process. Such thermal conduction through the resistive layer can cause dissociation and tearing of the ribbon. In turn, the mechanical stability of the ribbon over the entire operating range of printing can be adversely affected, leading to limited reliability and reduced print quality.

Another potential problem is that the electrical current layer (Al) is subject to corrosion when the polymer resistive layer is applied, and can be exposed to moisture permeating through the polymer layer. This can lead to a limited shelf life of the ribbon and to changes in its ink transfer properties. Further, the resistive layer-/aluminum adhésion will be adversely affected if the resistive layer does not cover all pinholes that may be present in the Al layer. Thus, the resistive layer/Al interface is a critical region of the ribbon, as it affects print quality, shelf life, and overall ribbon durability.

Accordingly, it is a primary object of the present invention to provide a resistive printing ribbon having improved thermal properties.

It is another object of the present invention to provide a resistive printing ribbon that exhibits superior mechanical strength.

It is another object of the present invention to provide an improved resistive printing ribbon having superior thermal and mechanical properties at the interface of the resistive layer and the electric current return layer.

It is another object of the present invention to provide a resistive printing ribbon having improved adhesion between the electrical current layer and the resistive layer thereof, and in which the heat generated during printing has a minimal effect on the bulk of the resistive layer.

It is another object of this invention to produce an improved resistive printing ribbon wherein a high temperature polymer is produced near the resistive layer-/electrical current layer interface, the high temperature polymer being produced without additional fabrication steps.

It is another object of the present invention to provide an enhanced resistive layer in a resistive printing ribbon, where the resistive layer is easily fabricated and has improved thermal properties in the region of the resistive layer where the most intense heat is produced during thermal printing.

It is another object of this invention to provide an improved resistive ribbon for thermal transfer printing, where the thermal and mechanical properties at the electric current return layer/resistive layer interface are significantly improved without altering the mechanical and electrical properties of the rest of the resistive layer.

DISCLOSURE OF THE INVENTION

The resistive ribbons of this invention include at least a resistive layer, an electrical current return layer, and a layer of thermally fusible ink. A transfer layer is optionally located adjacent to the ink layer in order to facilitate transfer of ink from the ribbon to a carrier, such as paper.

The improvement wherein the above-listed objects are achieved is based on the provision of a thermally and mechanically superior surface layer adjacent to the electrical current return layer. This thermally superior layer is a polymer located in the resistive layer, and is produced by phase-segregation of selected additives in the resistive layer. These additives are included at the same time the resistive layer is formed, and undergo phase separation and a movement toward the surface of the resistive layer adjacent to the electrical current return layer. In this manner, a thin surface region having enhanced thermal and mechanical properties is provided at a location very close to that where the most intense localized heating is produced during printing. These enhanced properties lead to enhanced mechanical stability of the ribbon and improved print quality. In addition, the thermally and mechanically superior polymer is provided without requiring additional fabrication steps and, because of the thinness of this surface region and its location at the critical interface, the remaining portion of the resistive layer is not altered with respect to its mechanical and electrical properties.

The additives which are incorporated into the polymeric material comprising the resistive layer consist of graphite fluorides, fluorocarbons such as Teflon (a trademark of E.I. Dupont deNemours, Inc.), and cerium fluoride ($CeF_4$). In general, these additives have a degree of fluorination such that they exhibit a lower surface energy than the remainder of the polymeric resistive layer. This causes their phase separation in the resistive layer, and a consequent migration toward the surface of the resistive layer that is adjacent to the electrical current return layer. The polymeric resistive layer in which these additives are present can be comprised of a polymer having conductive particles therein, for example, any of the known materials, such as polycarbonates, polyurethanes, polystyrenes, polyketones, and polyesters. The conductive particles in the polymeric binder necessary to produce the desired electrical resistivity are well known in the art and include, for example, carbon black, zinc, etc.

The altered surface region of the resistive layer, produced by phase-separation of graphite fluorides, fluorocarbon resins, or $CeF_4$, is typically 20–500 angstroms thick. This is the approximate range in which the additives cluster during the phase-separation process.

These and other objects, features, and advantages will be apparent from the following more particular description of the preferred embodiments.

BRIEF DESCRIPTION OF THE DRAWINGS

The figure schematically illustrates resistive ribbon thermal transfer printing, and the improved resistive ribbon of this invention.

BEST MODE FOR CARRYING OUT THE INVENTION

In the practice of this invention, an improved multilayer resistive printing ribbon 10 is employed in order to enhance print quality and increase ribbon life. This is accomplished by the formation of a surface polymer region in the resistive layer which has superior thermal and mechanical properties. The rest of the ribbon 10 can be the same as conventionally used ribbons, and the operation of the ribbon is identical to that of other resistive printing ribbons.

Ribbon 10 is comprised of a resistive layer 12 having a surface polymer region 14 of enhanced properties, an electrical current return layer 16, and an ink layer 18. For the printing operation, ribbon 10 is in contact with the receiving medium, such as paper 20.

The print head 22 is comprised of a plurality of electrodes 24 connected to electrical current leads 26. Injecting electrical currents into the ribbon 10 by electrically addressing the print head electrodes 24 results in high current densities immediately beneath the addressed electrodes, which in turn results in highly localized heating of the ribbon beneath the addressed electrodes. This causes localized melting of the thermoplastic or thermally transferrable ink 18, the melted ink regions being then transferred to the paper 20. A broad area electrical current return electrode 28 is also in contact with ribbon 10, in order to complete the electrical circuit.

The materials generally used for the various layers 12, 16, and 18 of ribbon 10 are well known in the art, and will not be described in detail. Further, although an ink transfer layer is not shown in this figure, it will be appreciated by those of skill in the art that such a layer can be provided between the electrical current return layer 16 and the ink layer 18, in order to facilitate transfer of the ink to the receiving medium 20.

In a typical ribbon, the resistive layer is about 16 micrometers thick, while the electric current return layer 16 is about 0.1 micrometers thick. The thermally fusible ink layer 18 is generally about 5 micrometers thick. These dimensions can be changed in accordance with the printing requirements, but are representative of the dimensions used in ribbons where printing is at relatively low power requirements. For example, ribbons having these dimensions can be used to print with powers of approximately 3 joules/cm$^2$. Ideally, the ribbon is fabricated such that all of the heat is generated in the ink layer 18. This approach would result in minimal thermal and electrical energy requirements for printing. However, practical considerations do not allow this and, for this reason, the heat is generated in resistive layer 12, and more particularly at a location close to the interface of the resistive layer 14 and the current return layer 16.

As noted previously, the resistive layer 12 can be comprised of a polymeric material including, but not limited to the following polymers: polycarbonates, polyurethanes of the type described in U.S. Pat. No. 4,320,170, polystyrenes, polyketones, polyesters, etc. Of these, the polycarbonates are generally found to be superior in terms of the mechanical and electrical properties of the ribbon which can be obtained when polycarbonates are used. In order to obtain the desired electrical resistivity, a conductive pigment is loaded into the polymer. Carbon black, such as Cabot XC-72, is a preferred conductive pigment. The appropriate pigment loading is determined from a consideration of the electrical and mechanical requirements of the ribbon 10. For example, for a polycarbonate resistive layer having a thickness 14–16 micrometers, carbon loading in the range of about 25–30% by weight will provide a ribbon having suitable bulk resistivities and adequate mechanical properties. These mechanical properties include the tensile strength of the ribbon, its percentage of elongation during use, and its modulus of elasticity.

The electrically conductive, current return layer 16 serves as both an electrical return path of low resistivity and a means for "focussing" or reducing the lateral spreading of the printing current. The current focussing occurs since the lowest resistance path from the print electrode to the return electrode 28 is directly through the ribbon and then via the conductive layer 16 to the return electrode. This focussing of the current results in improved print resolution due to the improved localization of the heat generated beneath the print electrodes.

Although many conductive materials can be used for current return layer 16, including copper, gold, aluminum, graphite, and stainless steel, it has been found that aluminum provides the most desireable properties. The layer 16 can be deposited on the resistive polymer layer 12 by any suitable technique, including mechanical buffing, electroless deposition, and vacuum evaporation.

When aluminum is used as the conductive layer 16, it is usually the situation that a very thin aluminum oxide film forms at the boundary between aluminum layer 16 and the resistive polymer layer 12. Electrical breakdown in this aluminum oxide film may be caused due to increased heat generation directly at the aluminum/resistive polymer interface and the focussed current flow in the regions of the aluminum oxide where electrical breakdown occurs.

The ink layer 18 can be any ink layer of the types well known in the art, and is not critical to the performance and operation of the present invention. Generally, ink layer 18 is comprised of a theromplastic based ink such as that desribed in U.S. Pat. No. 4,308,318, rather than a wax based ink. The melting temperature of the thermoplastic ink resin is considerably lower than the glass transition temperature of the resistive layer 12. The chemical and mechanical properties required for the ink layer 18 are well known in the art, and the choice of a suitable ink is made in accordance with those requirements. Thus, the use of an improved resistive layer in the present ribbon does not restrict the type of ink that may be employed; instead, by enhancing the delivery of thermal energy to the ink layer, the choice of a suitable ink material is simpler, since a greater range of compositions can be employed.

The resistive layer 12 of this ribbon includes a surface region 14 thereof which is a high temperature polymer, i.e., a polymer that is able to withstand higher temperatures than can be withstood by the rest of the resistive layer 12. This surface region also enhances adhesion between the layer 16 and the resistive layer and provides passivation for layer 16, preventing the adverse effects of moisture permeation through the organic resistance layer to layer 16. These advantages are particularly important when the layer 16 is an Al layer.

To obtain this high temperature polymer at the region of the resistive layer 12 close to the current return layer 16, a certain type of additive is incorporated in the polymeric resistive layer when it is being prepared. The additive is a material which imparts a higher degree of thermal and mechanical stability to the resistive layer at the critical location close to its interface with current return layer 16. The additive also has the property that it is capable of phase-separating in the resist layer during the fabrication of the resist layer. This phase separation allows the additive to concentrate in the surface region of the resist layer.

In order to be able to phase-separate in the resist layer, the additive must be one which has a lower surface energy than the remainder of the resistive layer 12. Further, the main importance of the additive is with respect to its thermal properties and to the enhancement it provides with respect to A1—resistive layer adhesion and passivation at the Al—resistive layer interface. Its physical properties, such as tensile strength and glass transition temperature $T_g$, are not as critical, since the additive is concentrated in a thin surface region of the resistive layer rather than being dispersed throughout the bulk of the resistive layer. Consequently, the additive can be chosen to provide a marked improvement in the thermal and mechanical properties of the resistive layer. Al interfacial region, without altering the overall mechanical and electrical properties of the resistive layer. This provides ease in the design of the resistive layer, since the design considerations that are conventionally used can still be employed in the design of the improved ribbons of this invention.

Examples of additives which will phase-segregate in conventionally used resistive layer binders include graphite fluoride, fluorocarbon resins such as Teflon TM, and Cerium fluoride ($CeF_4$). Graphite fluorides such as Fluorographite TM (a product of Ozark-Mahoning) can be commercially obtained as particles, having sizes ranging from about 1 micron to about 40 microns. Also, Teflon TM micropowder resins are available from DuPont in particle sizes ranging from about 0.5 to about 5 microns.

Graphite fluoride $(CF_x)_n$ is available in a range of degrees of fluorination. In the practice of this invention, the degree of fluorination x ranges from 0.5 to 1. This is important insofar as the surface energy of the graphite fluoride is dependent upon its degree of fluorination. Generally, as the degree of fluorination x increases, the surface energy of the graphite fluoride will decrease, but so will its temperature resistance. Consequently, the degree of fluorination is chosen to provide the maximum resistance to temperature while at the same time providing a sufficiently low surface energy that the graphite fluoride, or other additive, will phase-separate in the polymer chosen as the binder of the resistive layer 12 For conventionally used binder materials, such as those illustrated previously, a degree of fluorination of about 0.5–1 will provide a good high temperature polymer at the interface of the resistive layer and the current return layer.

As a representative example, the resistive layer 12 can have an overall thickness of about 17 micrometers and the altered surface region 14 can have a thickness of approximately 20–500 angstroms. The thickness of region 14 is dependent upon the type of polymer used in resistive layer 12, and on the amount of the low surface energy additive included in the resistive layer. For a region 14 having a thickness of approximately 5% of the total thickness of resist layer 12, the amount of additive ranges from about 0.3 to about 0.7 percent by weight.

Generally, it is desireable to produce only a thin region 14 so as not to alter the electrical and mechanical properties of the bulk of the resistive layer. One of the primary features of this invention is the provision of an additive which will phase-separate in the resistive layer, and concentrate in a thin region closest to the region of maximum temperature during the printing operation. This means that a lesser amount of additive is required than would be required if the additive were dispersed throughout the volume of the resistive layer. It also means that the additive is concentrated in the region where its need is greatest, and its presence there reduces the amount of thermal damage done to the rest of the resistive layer during printing. For this reason also, these ribbons have greater lifetimes during printing.

As noted, the surface region 14 is formed without additional process steps. It is only necessary to add the graphite fluoride, fluorocarbon resin, and/or Cerium fluoride when the resistive layer is being prepared. The steps used to form the resistive layer need not be changed from the conventional techniques, such as web coating. When the resistive layer is dried in an oven, phase-separation of the additive will occur so that the additives will automatically move to the location where they are most effective.

The use of these additives and the concept of providing a thermally and mechanically superior polymer close to the interface of the resistive layer and the current return layer is particularly desireable when the current return layer is an aluminum layer. As noted, a naturally occurring aluminum oxide often forms on the aluminum layer. In the practice of this invention, it has been found that the high temperature polymer in contact with the aluminum oxide provides enhanced adhesion and better coverage of the aluminum oxide, thereby causing fewer pinholes in the aluminum. The additive also produces a polymer which serves as a passivation layer with the underlying aluminum layer and reduces the possibility of aluminum corrosion. Since the high temperature polymer does not dissociate even at the high temperatures produced at the interface region (250°–400° C.,) the ribbon integrity is preserved and the high temperature polymer protects the remainder of the resistive layer whose dissociation temperature is lower. For example, the presence of graphite fluorides in polycarbonate will produce a high temperature polymer whose dissociation temperature is greater than 800° C. This contrasts with the dissociation temperature of a polycarbonate resistive layer, which is less than half the dissociation temperature of the graphite fluoride polymer.

Materials such as graphite fluoride and Teflon TM have been used as lubricants in electroerosion ribbons. This is exemplified in U.S. Pat. Nos. 4,554,562 and 4,567,490 In electroerosion printing, considerable mechanical wear occurs in the ribbon due to scraping of the recording styli across the ribbon surface. However, the need for such a lubricant is not present in resistive ribbon transfer printing, and one would not be led to use these additives where they would not be needed for a lubrication purpose. Still further, the present invention is based on the recognition that most of the heating occurs at the interface between the resistive layer and the current return layer, and this heating is maximized when aluminum is used as the current return material. Thus, the present invention is directed to the provision of a thermally resistant polymer close to the aluminum oxide layer which will ensure that the maximum heating effect is closest to the ink layer, while at the same time protecting the remainder of the polymer resistive layer from adverse thermal effects.

While the invention has been described with respect to particular embodiments thereof, it will be apparent to those of skill in the art that variations can be made therein without departing from the spirit and scope of the present invention. For example, resistive polymer and additive combinations other than those described herein can be envisioned which will satisfy the criteria of this invention.

Having thus described our invention, what we claim as new and desire to secure by Letters Patent is:

1. A resistive ribbon for thermal transfer printing, comprising:

a resistive layer through which electrical current passes to effect said printing, said resistive layer including a phase separated surface region imparting enhanced mechanical and thermal properties to said resistive layer, said phase separated surface region including a material selected from the group consisting of graphite fluoride, fluorocarbon resins, and $CeF_4$, a thin layer of an electrically conductive material through which said electrical current passes, said thin layer being adjacent said phase separated surface region and a thermally fusible ink layer capable of being melted once said electrical current flows through said resistive layer.

2. The ribbon of claim 1, where said phase-separated surface region has a thickness less than about 0.5% of the total thickness of said resistive layer.

3. The ribbon of claim 1, where said resistive layer is comprised of a polymer having electrically conductive particles therein.

4. The ribbon of claim 3, where said thin layer of said electrically conducting material is aluminum.

5. The ribbon of claim 4, wherein said polymer is a polycarbonate.

6. A resistive ribbon for thermal transfer printing, comprised of:

a thin layer of aluminum having a thin film of aluminum oxide thereon, a resistive layer through which electrical current passes to effect said thermal transfer printing, said resistive layer being comprised of a polymer binder having electrically conductive particles therein and further including an additive of lower surface energy than said polymer binder, said additive phase separating and concentrating near the interface of said resistive layer and said aluminum layer to form a temperature resistant polymer thereat having a thermal dissociation temperature greater than the thermal dissociation temperature of said polymer binder, said additive being selected from the group consisting of graphite fluorides fluorocarbon resins, and $CeF_4$, and a layer of thermally fusible ink capable of being melted when said electrical current flows through said resistive layer.

7. The ribbon of claim 6, where said fluorocarbon resin includes Teflon TM.

8. The ribbon of claim 6, where said graphite fluoride is given by the expression $(CF_x)_n$, where the degree of fluorination x is between about 0.5 and 1.

9. The ribbon of claim 6, where said polymer binder is a polycarbonate.

10. The ribbon of claim 6, where said electrically conductive particles are carbon particles.

11. The ribbon of claim 6, where said temperature resistant polymer has a thickness less than about 0.5% of the total thickness of said resistive layer.

12. A resistive ribbon for thermal transfer printing, comprising:

a layer of aluminum, a resistive layer located on one side of said aluminum layer, said resistive layer being a polymer binder having conductive particles therein and including an additive selected from the group consisting of graphite fluorides, fluorocarbon resins, and ($CeF_4$), said additive having a lower surface energy than said polymer binder and phase separating in said polymer binder to concentrate in a thin surface region near the interface of said resistive layer and said aluminum layer, said phase-separated additive imparting superior thermal and mechanical properties to the interface region of said resistive layer and said aluminum layer, and a layer of thermally fusible ink.

13. The ribbon of claim 12, where said polymer binder is polycarbonate.

14. The ribbon of claim 13, where said conductive particles are carbon.

15. The ribbon of claim 14, where said thin surface region is less than about 500 angstroms thick.

* * * * *